US011401777B2

(12) United States Patent
Shafer

(10) Patent No.: US 11,401,777 B2
(45) **Date of Patent: *Aug. 2, 2022**

(54) THROUGH TUBING P AND A WITH TWO-MATERIAL PLUGS

(71) Applicant: CONOCOPHILLIPS COMPANY, Houston, TX (US)

(72) Inventor: Randall S. Shafer, Houston, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/927,395

(22) Filed: Jul. 13, 2020

(65) Prior Publication Data

US 2020/0408062 A1 Dec. 31, 2020

Related U.S. Application Data

(63) Continuation of application No. 15/717,352, filed on Sep. 27, 2017, now Pat. No. 10,738,567.

(Continued)

(51) Int. Cl.
*E21B 33/13* (2006.01)
*E21B 33/134* (2006.01)

(Continued)

(52) U.S. Cl.
CPC ..... *E21B 33/13* (2013.01); *E21B 29/002* (2013.01); *E21B 33/134* (2013.01); *E21B 43/11* (2013.01); *E21B 47/00* (2013.01); *E21B 47/005* (2020.05)

(58) Field of Classification Search
CPC ..... E21B 33/13; E21B 47/005; E21B 33/134; E21B 29/002; E21B 43/11; E21B 47/00
See application file for complete search history.

(56) References Cited

U.S. PATENT DOCUMENTS 2,286,075 A 6/1942 Evans
3,170,516 A * 2/1965 Corley, Jr. ..... E21B 33/134 166/286

(Continued)

FOREIGN PATENT DOCUMENTS

WO 2011151271 12/2011
WO 2012001342 1/2012

(Continued)

OTHER PUBLICATIONS

International Search Report, PCT/US2018/058228, dated Jan. 18, 2019, 2 pages.

(Continued)

*Primary Examiner* — Brad Harcourt
(74) *Attorney, Agent, or Firm* — Boulware & Valoir; Tamsen Valoir

(57) ABSTRACT

Methods of plugging a hydrocarbon well by a through-tubing technique wherein the tubing is left in place, and only very short (<5 m) sections are cut, milled, perforated, ruptured and expanded, or combinations thereof. A blocking device is sent downhole if needed to block a bottom of the plug section, and resin dropped onto the blocking device to make a first plug, then cement is deployed onto said first plug to form a second plug. Therefore, the final interval is plugged with a two material binary plug. Once completed, and both primary and secondary barriers are in place, the well can be closed and the Christmas tree removed. A rock-to-rock plug can be set by removing or partially removing the tubular and the outer casing, or just inner casing/tubulars can be removed if the exterior cement and casing are of sufficient quality.

20 Claims, 7 Drawing Sheets

Related U.S. Application Data

(60) Provisional application No. 62/402,821, filed on Sep. 30, 2016.

(51) Int. Cl.

| | |
|---|---|
| ***E21B 47/005*** | (2012.01) |
| ***E21B 29/00*** | (2006.01) |
| ***E21B 43/11*** | (2006.01) |
| ***E21B 47/00*** | (2012.01) |

(56) References Cited

U.S. PATENT DOCUMENTS

| | | | | |
|---|---|---|---|---|
| 3,618,639 | A | 11/1971 | Daley | |
| 3,830,299 | A | 8/1974 | Thomeer | |
| 4,043,394 | A * | 8/1977 | Campbell | E21B 33/13 166/253.1 |
| 4,607,694 | A | 8/1986 | Sah | |
| 5,833,001 | A | 11/1998 | Song | |
| 6,474,414 | B1 | 11/2002 | Gonzalez et al. | |
| 6,478,088 | B1 | 11/2002 | Hansen et al. | |
| 6,664,522 | B2 | 12/2003 | Spencer | |
| 6,679,328 | B2 | 1/2004 | Davis et al. | |
| 6,802,375 | B2 | 10/2004 | Bosma et al. | |
| 6,828,531 | B2 | 12/2004 | Spencer | |
| 6,923,263 | B2 | 8/2005 | Eden et al. | |
| 7,152,657 | B2 | 12/2006 | Bosma et al. | |
| 7,290,609 | B2 | 11/2007 | Wardlaw et al. | |
| 7,455,104 | B2 | 11/2008 | Duhon et al. | |
| 9,010,425 | B2 | 4/2015 | Larsen et al. | |
| 9,022,117 | B2 | 5/2015 | Segura et al. | |
| 9,181,775 | B2 | 11/2015 | Eden | |
| 9,334,712 | B2 | 5/2016 | Bakken et al. | |
| 9,550,933 | B2 | 1/2017 | Chatterji et al. | |
| 9,664,012 | B2 | 5/2017 | Deutch et al. | |
| 10,316,612 | B2 | 6/2019 | Shafer | |
| 10,533,123 | B2 | 1/2020 | Kulkarni et al. | |
| 10,648,279 | B2 | 5/2020 | Shafer | |
| 10,738,567 | B2 * | 8/2020 | Shafer | E21B 29/002 |
| 10,883,336 | B2 | 1/2021 | Prieur et al. | |
| 2002/0056553 | A1 | 5/2002 | Duhon | |
| 2004/0040710 | A1 | 3/2004 | Eden et al. | |
| 2005/0109511 | A1 | 5/2005 | Spencer | |
| 2006/0037748 | A1 | 2/2006 | Wardlaw et al. | |
| 2006/0144591 | A1 | 7/2006 | Gonzalez et al. | |
| 2007/0137826 | A1 | 6/2007 | Bosma et al. | |
| 2008/0028922 | A1 | 2/2008 | Wilson et al. | |
| 2008/0047708 | A1 | 2/2008 | Spencer | |
| 2009/0120643 | A1 * | 5/2009 | Sun | E21B 33/13 166/292 |
| 2009/0301337 | A1 | 12/2009 | Wilson et al. | |
| 2010/0006289 | A1 | 1/2010 | Spencer | |
| 2010/0155085 | A1 | 6/2010 | Spencer | |
| 2010/0268439 | A1 | 10/2010 | Lie et al. | |
| 2010/0294569 | A1 | 11/2010 | Aldred et al. | |
| 2011/0000668 | A1 | 1/2011 | Tunget | |
| 2011/0167795 | A1 | 7/2011 | Gangopadhyay et al. | |
| 2011/0188346 | A1 | 8/2011 | Hull | |
| 2011/0203795 | A1 | 8/2011 | Murphy et al. | |
| 2011/0209871 | A1 | 9/2011 | Le | |
| 2012/0298359 | A1 | 11/2012 | Eden et al. | |
| 2013/0087335 | A1 | 4/2013 | Carragher et al. | |
| 2013/0333890 | A1 | 12/2013 | Dagenais et al. | |
| 2015/0034317 | A1 | 2/2015 | Skjold | |
| 2015/0034341 | A1 | 2/2015 | Pigeon | |
| 2015/0053405 | A1 | 2/2015 | Bakken | |
| 2015/0211322 | A1 | 7/2015 | Lowry et al. | |
| 2015/0211326 | A1 | 7/2015 | Lowry et al. | |
| 2015/0211327 | A1 | 7/2015 | Lowry et al. | |
| 2015/0211328 | A1 | 7/2015 | Lowry et al. | |
| 2015/0343417 | A1 | 12/2015 | Puranik et al. | |
| 2015/0345248 | A1 | 12/2015 | Carragher | |
| 2015/0368542 | A1 | 12/2015 | Carragher | |
| 2016/0010423 | A1 | 1/2016 | Myhre et al. | |
| 2016/0145962 | A1 | 5/2016 | Carragher | |
| 2016/0195378 | A1 | 7/2016 | Medina et al. | |
| 2017/0145782 | A1 * | 5/2017 | Ferg | E21B 43/105 |
| 2018/0003001 | A1 | 1/2018 | Pipchuk | |
| 2018/0094504 | A1 | 4/2018 | Hearn et al. | |
| 2018/0148991 | A1 | 5/2018 | Hearn et al. | |
| 2018/0216437 | A1 | 8/2018 | Shafer | |
| 2019/0085659 | A1 | 3/2019 | Carragher | |
| 2019/0128092 | A1 | 5/2019 | Mueller et al. | |

FOREIGN PATENT DOCUMENTS

| | | |
|---|---|---|
| WO | 2013085621 | 6/2013 |
| WO | 2013315583 | 9/2013 |
| WO | 2014096858 | 6/2014 |
| WO | 2014108431 | 7/2014 |
| WO | 20150116261 | 8/2015 |
| WO | 2016049424 | 3/2016 |

OTHER PUBLICATIONS

International Search Report, PCT/US2017/051851, dated Dec. 5, 2017, 3 pages.

International Search Report, PCT/US2017/051745, dated Nov. 20, 2017; 2 pages.

Piercey, Davin G., et al., Nanoscale Aluminum—Metal Oxide (Thermite) Reactions for Application in Energetic Materials, Central European Journal of Energetic Materials, 2010, 7(2), 115-129.

Puszynski, Jan A., et al., Ignition Characteristics of Nanothermite Systems, International Journal of Energetic Materials and Chemical Propulsion, vol. 7, 2008, Issue 1, pp. 73-86.

Puszynski, Jan A., et al., Processing of Aluminum-Based Nanothermitesin a Circulating Mixer, found at https://ndiastorage.blob.core.usgovcloudapi.net/ndia/2009/gunmissile/7784swiatkiewTuesday.pdf.

International Search Report, PCT/US2017/053733, dated Jan. 2, 2018, 2 pgs.

Office Action for U.S. Appl. No. 17/075,897 dated Mar. 2, 2022.

* cited by examiner

THROUGH TUBING P AND A WITH TWO-MATERIAL PLUGS

PRIOR RELATED APPLICATIONS

This application is a Continuation application claiming priority to U.S. application Ser. No. 15/717,352, filed Sep. 27, 2017, which claims priority to U.S. Provisional Application 62/402,821, filed Sep. 30, 2016, each incorporated by reference herein in its entirety for all purposes.

FIELD OF THE INVENTION

The invention relates to methods, systems and devices for plug and abandonment operations to shut down a well or a portion thereof.

BACKGROUND

The decision to plug and abandon (P&A) a well or field is an economic decision. Once production value drops below operating expenses, it is time to consider abandonment, even if considerable reserves remain. Thus, well abandonment is an inevitable stage in the lifespan of a well.

It is also possible to abandon only part of a well. One cost effective way to enhance production is to permanently abandon the bottom of the well, but use the existing slot to sidetrack the well to reach new pay-zones. The cost can often be cut in half when sidetracking an existing well instead of drilling a new horizontal well. This process is known as "slot recovery."

Plugging can also be temporary, e.g., to allow for workover, a long shut-in, or for converting an exploratory well to a production well. Norwegian standards state that the integrity of materials used for temporary abandonment should be ensured for the planned abandonment period times two.

In oilfield jargon "plug and abandon" or "P&A" refers to preparing a well to be closed permanently (or at least until prices or technology developments warrant reentry). The earliest oil wells were abandoned without any plugging, but the first plugging requirements were enacted by Pennsylvania in the 1890s. However, prior to modern regulations set in the '50s, many wells were abandoned with plugs consisting of brush, wood, paper sacks, linen or any other material that could be pushed into a well to form a basis for the dumping of one or two sacks of cement to "plug" the well. Current procedures are significantly more disciplined however.

Plugging and abandonment (P&A) regulations vary among states and between countries, but all regulations prescribe the depth intervals that must be cemented, as well as the materials that are allowed in plugging practices. Most states require that cement plugs be placed and tested across any open hydrocarbon-bearing formations, across all casing shoes, across freshwater aquifers, and perhaps several other areas near the surface, including the top 20 to 50 ft [6 to 15 m] of the wellbore. Many countries and states require that a "rock-to-rock" cement plug be set that is contact with wellbore outside the casing if the casing is not adequately isolated with cement.

In recognition of its strength, low permeability and low cost, cement typically is used to create a seal between formations or to seal off the surface of the wellbore. Other materials that do not offer the same strength or durability as cement, including drilling mud, gel, and clay, are used to fill in the spaces between cement plugs. Additionally, many states allow the use of mechanical bridge plugs in lieu of a large cement plug since the bridge plug is extremely strong and nearly completely impermeable. However, mechanical plugs are susceptible to corrosion, and therefore the regulations typically require the bridge plugs to be capped by a specified amount of cement.

The basics of P&A operations vary little, whether the well is on land or offshore. Operators remove the completion hardware, set plugs and squeeze cement into the annuli at specified depths across producing and water-bearing zones to act as permanent barriers to pressure from above and below, in addition to protecting the formation against which the cement is set. Operators remove the wellhead last. Some basic plugs are shown in FIG. 1.

Balanced plug technique is the most common placement method used in abandonment operations today. A tubing or a drill string is lowered to the desired depth for the plug base and the cement slurry is pumped until the cement slurry level is the same inside and outside of the string. When the cement height is the same on the inside of the tubing as in the annulus, the pipe is slowly pulled out. The pipe will be pulled out with a speed so that the fluid level is balanced at all times. When the pipe reaches the cement-spacer interface, little or no mixing between the spacer and the cement will occur if the interfaces between the fluids are the same both inside and outside the pipe.

One of the main problems in any cementing procedure is contamination of the cement. Poor mud-removal in the area where the cement is to be set can give rise to channels through the plug caused by the drilling fluid. To avoid this, a spacer is often pumped before and after the cement slurry to wash the hole and to segregate the drilling fluid and the cement from each other.

Another cause for channeling is eccentricity of the tubing, indicating the importance of adequate use of centralizers, which hold the tubing in the center of the bore. The cement will have more difficulty moving on the narrow side of the tubing, tending to allow channeling in the narrow space, and even where channeling does not occur, the cement will be thinner on that side, and thus be weaker and more easily damaged. Cement shrinkage can also cause gaps between the plug and casing and between the plug and reservoir wall. (FIG. 2). Cement plug integrity is also influenced by the cement density, the condition of the pipe, and the additives used in the cement. The quality of the cement mixing equipment on location also plays a very large role in plug success.

Because cement is susceptible to channeling, shrinkage and other problems, most regulations require that a substantial length of well be filled with cement, ranging from 30 to 50 meters. Thus, the response to cements shortcomings is to simply use more cement, in the hopes that eventually a reliable barrier will be formed. However, a 50-meter length of cement plug can require 2 tons of cement, which is expensive and time consuming to deploy, and takes a long time to cure. Area preparation and tubular removal, which might require milling of casing strings, is also very time consuming. Where every day on an offshore rig costs as much as a half to a million dollars a day, there is a strong drive to reduce time and costs.

Other materials have been investigated for use as plugging material. Resins offer superior adhesion, resistance to many caustic and corrosive chemicals, excellent mechanical properties such as low yield point and low viscosity in the unset state, and flexibility and toughness after setting, but historically they have been difficult to deploy without premature setting and or reactivity with downhole fluids. Additionally, if resin is placed in same volume as cement, it would make resin use very expensive, probably prohibitively costly.

Today's resin materials have improved however, and include ThermaSet by Wellcem AS, CannSeal by AGR, and the WellLock® resin system by Halliburton®. M&D Industries also makes resin plugging materials, including LIQUID BRIDGE PLUG®S with a range of hardeners and accelerators. The WellLock® resin, for example, uses cross-linking between an amine hardener and epoxides, resulting in a cured three-dimensional infinite polymer network, and can be deployed without negative impact from exothermic reactions triggered by water.

New types of cement slurries consisting of geopolymeric materials have also been developed as alternative to the conventional lightweight cement slurry. Geopolymers are made of aluminum and silicon and they exhibit superior mechanical and chemical properties compared to the Class G cement. Geopolymers can provide a material with specific properties from a range of cement/fly-ash/aluminiosilicate component ratios. This gives a lightweight slurry with high compressive and flexural strength thought to replace the conventional lightweight cements containing silica fume.

Sandaband is another cement alternative. It is a sand-slurry consisting of about three quarters sand particles and one quarter water and other additives, developed in Norway to meet the increasing demands of an long lasting plugging material. Sandaband possesses the properties as a Bingham fluid and acts as a deformable solid when it's stationary, but as a liquid when in motion. This ductile behavior means that the sand slurry will never fracture or create micro annuli. The sand slurry is also incompressible and gas tight, and does not shrink, fracture or segregate. It does however require a solid foundation, as it will sink if placed on another fluid.

Today, regulators are increasingly demanding that operators remove sections of casing so that a plug may be set that is continuous across the entire borehole in a configuration often referred to as "rock-to-rock," and located in the cap rock above the reservoir. Because cement or other plugging material must go all the way to the formation wall, the typical procedure was to pull the tubing, mill the casing, and remove swarf before spotting the cement. See FIG. 3. However, this process may require multiple trips downhole and the tons of swarf that must be removed can accumulate in low flow zones, and has razor sharp edges, being hazardous to both drill crew and equipment. Plus, the method is expensive and time-consuming.

One response to these challenges has been the introduction of a system known as perforate, wash and cement or "PWC" in a single run. The PWC operation is designed to access the formation through perforations in the casing to place a rock-to-rock cement barrier without removing the casing, thus saving valuable rig time and eliminating the swarf problem. To use this system, the well must be secured, Christmas tree removed, tubing pulled, and then PWC job can be done.

The PWC method uses a special tool by Archer, described in US20150053405. The tool is made of pipe conveyed perforating guns attached below a wash tool, which is below a cement stinger. Using PWC, ConocoPhillips completed 20 PWC plug installations in the North Sea, reducing the time required to set a permanent plug to 2.6 days from 10.5 days using section milling. As a result, the company calculated a savings of 124 rig days over the course of the 20 PWC wells. Given that rig time can easily be upwards of half a million dollars per day for an offshore rig, even a few days less time required for P&A can mean significant cost savings.

Although an improvement, the PWC method has limitations. To date, the PWC method has not been successfully applied through multiple casings. Furthermore, it is difficult to implement this method if the pipe has deformed such that the lengthy tool can no longer enter through the deviated section.

Thus, what is needed in the art are better methods, devices and systems for P&A that are safe, create a reliable barrier, that are cost effective, and both faster and easier to perform than current methods. Ideally, the new method would not require rig time, and would be performed "through tubing," and could provide a "rock-to-rock" plug. An ideal system would not require securing the well, allow the Christmas tree to remain in place during operations acting as a barrier, avoid expensive modular offshore drilling unit or "MODU" use, and also avoid the rigging up of large BOP's and well control equipment.

SUMMARY

The present disclosure provides systems, methods and devices for P&A operations, wherein the production tubing is left in place, as is the Christmas tree, until the P&A is complete, and a two-material binary plug made of a resin and cement is placed in the well. The methods are also useful for other plugging operations, such as slot recovery, temporary abandonment, and the like. We have called this two material plug a "bi-plug" herein. The method is a "through tubing" P&A because the tubing is left in place for the operation. Typically, in P&A the tubing is pulled and the well is secured with barriers, plugs, fluid, or other methods and the Christmas tree is replaced with a well control equipment called a blowout preventer or "BOP." The Christmas tree would of course already be equipped with a BOP, but that device typically has a maximum size of 7 1/16" and it is typically replaced with a much larger BOP of 13 5/8" or larger, which typically requires a MODU to install for offshore wells.

"Through tubing" P&A, in contrast, means that the larger BOP will not have to be used because the well will be fully secured by permanent plugs in the wellbore before removing the Christmas tree. Because MODU use is avoided, the cost is $100,000 per day, compared to $500,000 or more per day for MODU use. Additionally, on some installations, two wells could be plugged at the same time if there was sufficient room for two or more P&A operations, further saving on costs and time.

Although the method is described as a "through tubing" method, the tubing is in fact actually removed (wholly or partially) at a small section to be plugged, however, the bulk of tubing remains in place. Thus, although removed, it is a much smaller section (to 5 m) than the 50-100 meters currently used in mill and plug techniques using cement plugs. Nevertheless, it is appropriately designated through tubing because the entirety of the tubing need not be pulled out of the well prior to the P&A operation. This disclosure describes a variety of ways to remove a short region of tubing and/or casing and access the plugging interval, but one preferred way is rupture and expansion.

A base plug or other blocking device is deployed to at or near the plugging zone. This blocking device can be set before casing and tubing removal, if set somewhat below the plugging zone, or can be placed after rupture and expansion at the base of the rupture and expansion zone, as desired. The base plug or blocking device should prevent at least 90% of the resin for falling downhole, at least 95%, preferably at least 99% or it may even provide a complete seal, although that is not a requirement.

A resin is then used to set a first plug, according to regulations and well dictates. If desired, the resin can be squeezed and or logged before the next step, but this is not a strict requirement.

In a second step, a cement cap is set on top of the resin plug, thus providing a two material plug, or a bi-plug (a binary plug having two sections of different materials adjacent each other). If desired, the cement can be squeezed and/or the bi-plug logged, depending on regulations and well dictates.

To the extent that the well at the section to be plugged is not cemented or is only poorly cemented, the method must first provide access to the annular space between the tubing and casing and between the outermost casing and reservoir so that the bi-plug can reach the reservoir. This can be done by rupture and expansion, perforation, cutting, milling, and other methods of either removing these tubulars, or rupturing them sufficiently for access. A preferred method uses directional charges, thus, the tubing and casing are left in place, but are ruptured and expanded, as is any poor quality cement outside the casing.

To the extent that the well at the section to be plugged is adequately cemented, the rupture and expansion is replaced by another method that leaves the exterior casing and annular cement intact. Thus, milling, cutting or other methods are used to remove a short (about 1 to 5 meters) section of the nested tubulars. The method then proceeds as above, setting a bi-plug.

If required, the bi-plug quality can be accessed by drilling a small hole out for logging tool access. Once bi-plug integrity is confirmed, the small hole can be plugged with either resin or cement, as described herein, or with an expandable alloy, such as described in co-pending COP 42399, U.S. Ser. No. 62/402,796, filed Sep. 30, 2016). This filled bi-plug thus provides a primary barrier, or a secondary barrier, or both, and once the barriers are in place, the Christmas tree can be removed, and the well closed for P&A.

In more detail, the invention includes any one or more of the flowing embodiment(s) in any one or more combination(s) thereof:

---

A through-tube method of plugging a hydrocarbon well, comprising:
deploying a tool downhole to remove or to rupture and expand both an inner tubular and an uncemented or poorly cemented exterior casing at a section of a well to be plugged;
deploying a blocking device downhole if needed to block a bottom of said section either before or after the previous step;
deploying a liquid resin downhole onto said blocking device to at least partially fill said section;
optionally squeezing said liquid resin;
allowing said resin to cure and form a first plug of resin; and
deploying a liquid cement downhole on top of said first plug;
optionally squeezing said liquid cement; and
allowing said liquid cement to cure and form a second plug of concrete, said first plug and said second plug forming a bi-plug made of two different materials.
A method of plugging a hydrocarbon well, comprising:
rupturing and expanding an inner tubular and an uncemented or poorly cemented exterior casing at a section of well to be plugged by rock-to-rock plugging;
logging said section to confirm access to reservoir rock and determine a size of said section;
deploying a blocking device downhole to block a bottom of said section;
deploying liquid resin downhole onto said blocking device, optionally squeezing said resin, and then curing said liquid resin to form a first plug;
deploying cement onto said first plug, optionally squeezing said cement, and then allowing said cement to cure to form a second plug, said first and said second plug together making a bi-plug that is a primary barrier, a secondary barrier or both;
boring said bi-plug and logging said bore;
filling said bore with cement, resin or sand.
setting a secondary barrier; and
removing a Christmas tree from said well, and abandoning said well
A through-tube method of plugging a hydrocarbon well, comprising;
removing an inner tubular, but not a cemented exterior casing, at a small section (1 to 5 m) of well to be
plugged;
deploying a blocking device downhole to block a bottom of said section;
deploying a liquid resin downhole onto said blocking device to partially fill said section and allow said resin to cure and form a first plug;
deploying cement downhole on fop of said first plug;
optionally squeezing said cement; and
allowing said cement to solidify and form a second plug adjacent to and touching said first plug, said first plug and said second plug together making a bi-plug.
A method as herein described, wherein a bore is drilled through said bi-plug, and said bored bi-plug is logged to confirm plug quality, and then said bore is refilled.
A method as herein described, wherein a bore is drilled through said bi-plug, and said bored bi-plug is logged to confirm plug quality, and then said bore is refilled with cement.
A method as herein described, wherein a wireline or coiled tubing deployed cutting tool is used in step a) to cut 1 to 5 meters of said inner tubular and said exterior casing or just said inner tubular in the casing is retained.
A method as herein described, wherein a wireline or coiled tubing deployed milling tool is used in removing step a) to mill a section (<5 m or <2 meter) of said inner tubular and/or said exterior casing or just said inner tubular in the casing is retained.
A method as herein described, wherein an energetic tool is used in step a) to rupture and expand said inner tubular and said exterior casing.
A method as herein described, wherein said bi-plug is logged to confirm plug quality.
A method as herein described, wherein said blocking device is a plug, a packer, a basket or melted metal alloy plug using bismuth alloy or other metal -continued A method as herein described, wherein said milling tool produced swarf and said swarf is removed by circulation or by chemical dissolution of said swarf.
A method as herein described, wherein said ruptured and expanded tubular and exterior casing are further perforated.
A method as herein described, wherein said milling tool uses upward milling and produces swarf that falls downhole.

As used herein, a "P&A" refers to plug and abandon. Regulations require that the plugs be of sufficient quality to be "permanent," never allowing formation fluids to leak. However, it is recognized that even a permanently plugged and abandoned well may be reopened at a later time for various reasons. Therefore, "permanent" does not imply that the well will not be reopened, but instead refers to the quality of the plug-it needing the potential to last for decades or more.

As used herein, a "blocking device" is any device used to prevent cement or alloy from falling downhole, e.g., it provides a stable base on which to set the cast-in-place abandonment plug. This can be a mechanical device, such as basket, inflatable basket, plug, packer, or a metal alloy plug formed by melting Bismuth alloy, and the like. The blocking device could also be non-mechanical device such as a cement plug, barite plug, sand plug, a bolus of extra heavy mud, combinations thereof, or any other non-mechanical blocking device. Since this only acts as a base for a permanent plug, it is not required to act as a permanent plug by itself, and the requirements are less stringent. The blocking device can even be the bottom of the well if near enough to the plug zone. The use of a non-mechanical plug may be beneficial to fill an irregular space left by, e.g., a rupture and expansion tool, and block the annular space of tubulars left in the well, but a mechanical device can be set somewhat below the plugging zone with efficacy too.

"Tubular" or "tubing" can be used generically to refer any type of oilfield pipe, such as drill pipe, drill collars, pup joints, casing, production tubing and pipeline. However, generally we have referred to the inner tubing, such as injection tubing or production tubing as tubulars herein. The outer one or more tubing sets, we have referred to as "casing" herein.

As used herein, a "joint" is a length of pipe, usually referring to drillpipe, casing or tubing. While there are different standard lengths, the most common drillpipe joint length is around 30 ft [9 m]. For casing, the most common length of a joint is 40 ft [12 m].

As used herein, a "tubular string" or "tubing string" refers to a number of joints, connected end to end (one at a time) so as to reach down into a well, e.g., a tubing string lowers a sucker rod pump to the fluid level. These can also be called just "string."

As used herein, a "Christmas tree" provides primary and back-up control facilities for normal production and wellbore shut-in. Christmas trees are found in a wide range of sizes and configurations, depending on the type and production characteristics of the well. The Christmas tree also incorporates facilities to enable safe access for well intervention operations, such as slickline, electric wireline or coiled tubing.

As used herein the "wellhead" refers to the surface termination of a wellbore that incorporates facilities for installing casing hangers during the well construction phase. The wellhead also incorporates a means of hanging the production tubing and installing the Christmas tree and surface flow-control facilities in preparation for the production phase of the well.

As used herein, a "blow out preventer" or "BOP" is a large device with a plurality of valves and fail-safes at the top of a well that may be closed if the drilling crew loses control of formation fluids. By closing the BOP (usually operated remotely via hydraulic actuators), the drilling crew usually regains control of the reservoir, and procedures can then be initiated to increase the mud density until it is possible to open the BOP and retain pressure control of the formation. BOPs come in a variety of styles, sizes and pressure ratings.

As used herein a "lubricator" is a long, high-pressure pipe fitted to the top of a wellhead or Christmas tree so that tools may be put into a high-pressure well. The top of the lubricator assembly includes a high-pressure grease-injection section and sealing elements. The lubricator is installed on top of the tree and tested, the tools placed in the lubricator and the lubricator pressurized to wellbore pressure. Then the top valves of the tree are opened to enable the tools to fall or be pumped into the wellbore under pressure. To remove the tools, the reverse process is used: the tools are pulled up into the lubricator under wellbore pressure, the tree valves are closed, the lubricator pressure is bled off, and then the lubricator may be opened to remove the tools.

As used herein "swarf" are the fine chips or coils of metal produced by milling the casing or tubing.

As used herein, a "cutter" is any downhole tube that can be used to cut casing or tubing, which is typically done when a tool is stuck, in order to retrieve the tubing string and send down fishing tools. There are a number of different types of such tools, some of which are named herein.

An "external cutter" is a type of cutter. The external cutter slips over the fish or tubing to be cut. Special hardened metal-cutters on the inside of the tool engage on the external surfaces of the fish. External cutters are generally used to remove the topmost, possibly damaged, portion of a fish to enable an overshot, or similar fishing tools, to engage on an undamaged surface.

As used herein, a "chemical cutter" is a type of cutter run on wireline to sever tubing at a predetermined point when the tubing string becomes stuck. When activated, the chemical cutter uses a small explosive charge to forcefully direct high-pressure jets of highly corrosive material in a circumferential pattern against the tubular wall. The nearly instantaneous massive corrosion of the surrounding tubing wall creates a relatively even cut with minimal distortion of the tubing, aiding subsequent fishing operations.

As used herein, a "jet cutter" is a type of cutter, generally run on wireline or coiled tubing, that uses the detonation of a shaped explosive charge to cut the surrounding tubing or casing wall. The cutting action leaves a relatively clean cut surface, although the explosive action tends to flare the cut ends.

As used herein, a "perforation tool" cuts small holes or slots in the tubulars. These are typically used to convert a designated region of casing to production use, the holes allowing ingress of oil. Such tools can also be used herein in the P&A process.

As used herein, an "expansion tool" is a downhole tool used to expand the diameter of a tubular. This is done either hydraulically, by applying mud pressure, or mechanically, by pulling the conical/tapered expansion tool, or by a rotating axial force.

As used herein a "rupture and expansion tool" is distinguished from an expansion tool, which leaves the casing intact, albeit bigger. Instead, this tool both ruptures and expands casing and tubing. Exemplary tools are being developed, and herein we have used prototypes that uses an energetic material (typically directional charges) that when ignited creates heat and large volume of gas in a short period of time. The material is designed to expand, rupture, and give annulus access in a controlled manner. Each device is designed for the particular tubular and casing in each well. The device can also be defined as "Tubular Expansion Rupture and Annular Access (TERAA)."

Yet another tool that could be used is a "laser cutter", such as the one developed by FORO Energy. They have developed a high-energy laser with low loss fiber optic cable that can be deployed down hole extremely rapidly and with millimeter accuracy.

As used herein a "cement bond log" or "CBL" is a representation of the integrity of the cement, especially whether the cement is adhering solidly to the outside of the casing. The log is typically obtained from one of a variety of sonic-type tools. The newer versions, called cement evaluation logs, along with their processing software, can give detailed, 360-degree representations of the integrity of the cement, whereas older versions may display a single line representing the integrated integrity around the casing. In this case, the CBL is used to determine that a good connection between the abandonment plug and the formation walls, and it can be used to check the quality of the resin plug as well.

A CBL can be generated with a "cement bond tool." Cement bond tools infer the quality of the bond between casing and the cement (or resin) placed in the annulus between the casing and the wellbore. The measurement is made by using acoustic (sonic and ultrasonic) tools.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein:

| ABBREVIATION | TERM |
|---|---|
| API | American Petroleum Institute, which promulgates tubing standards, etc. |
| P&A | Plug and abandonment |
| CBL | Cement bond log |

DETAILED DESCRIPTION

Developed herein is a method of plug and abandonment, which is shown schematically in various embodiments in FIG. 4A-H.

Figure 1:
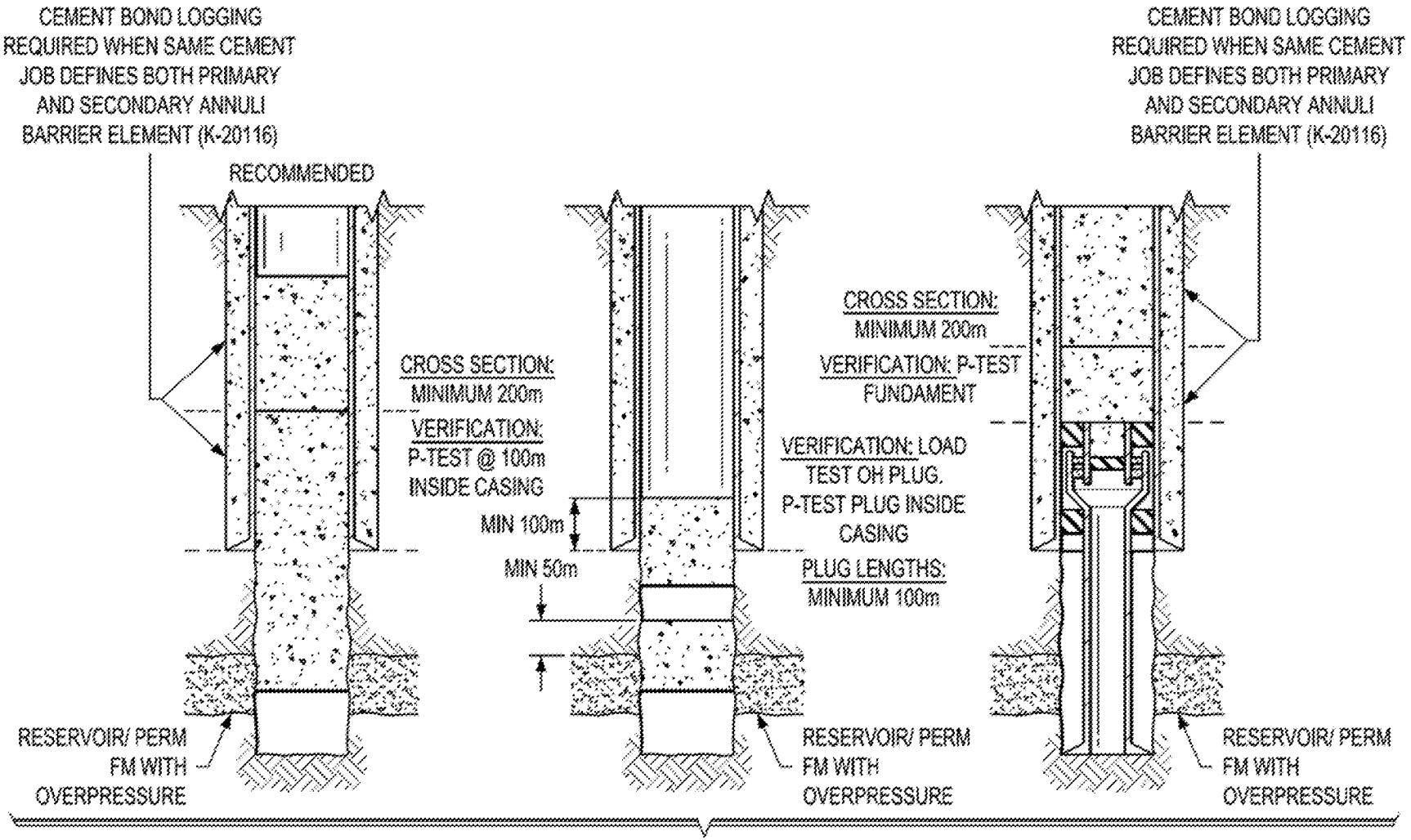
FIG. 1 provides a simple schematic of some basic plugs.
Figure 2:
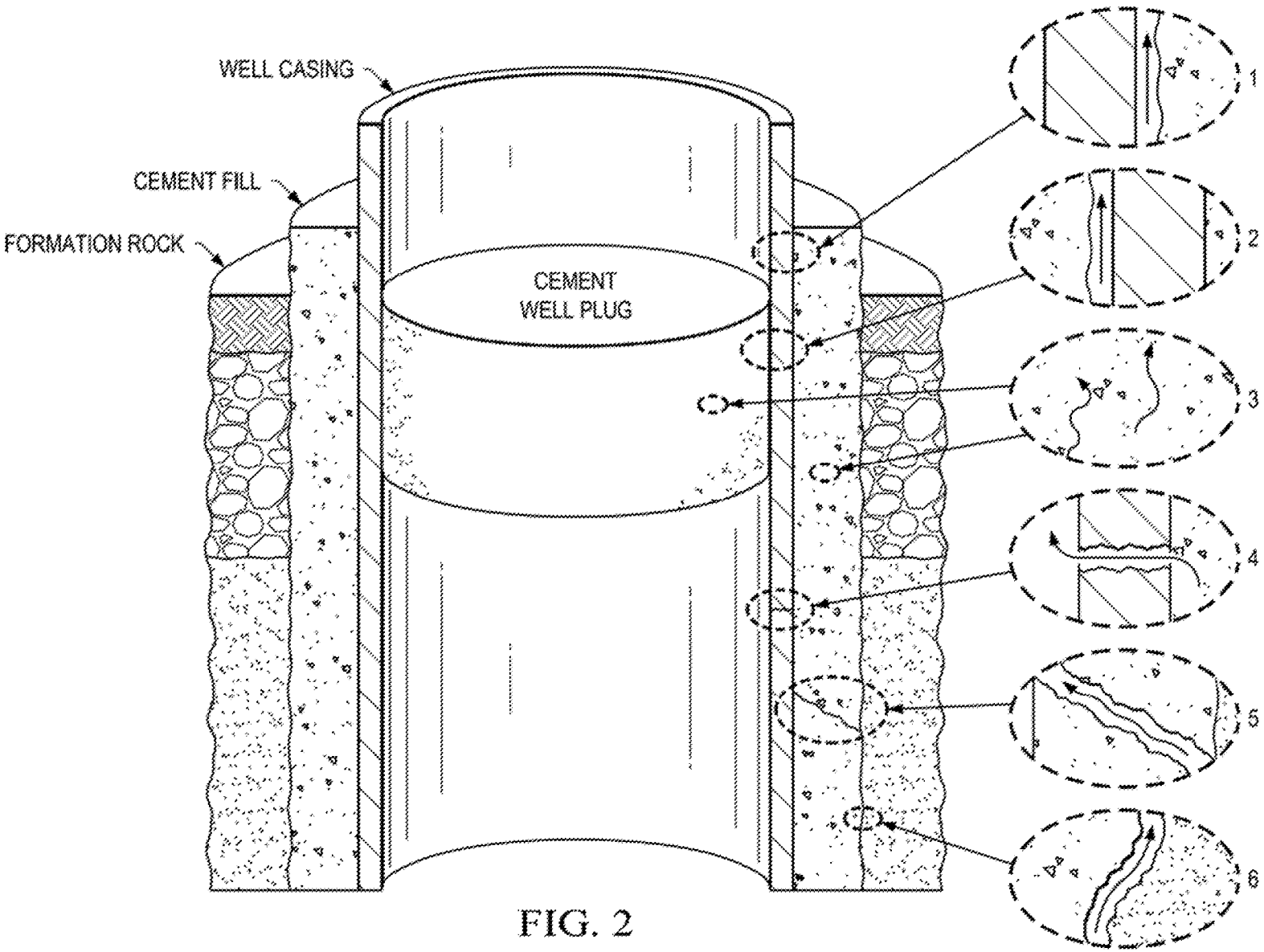
FIG. 2 provides possible leakage pathways often found in cement plugs.
Figure 3:
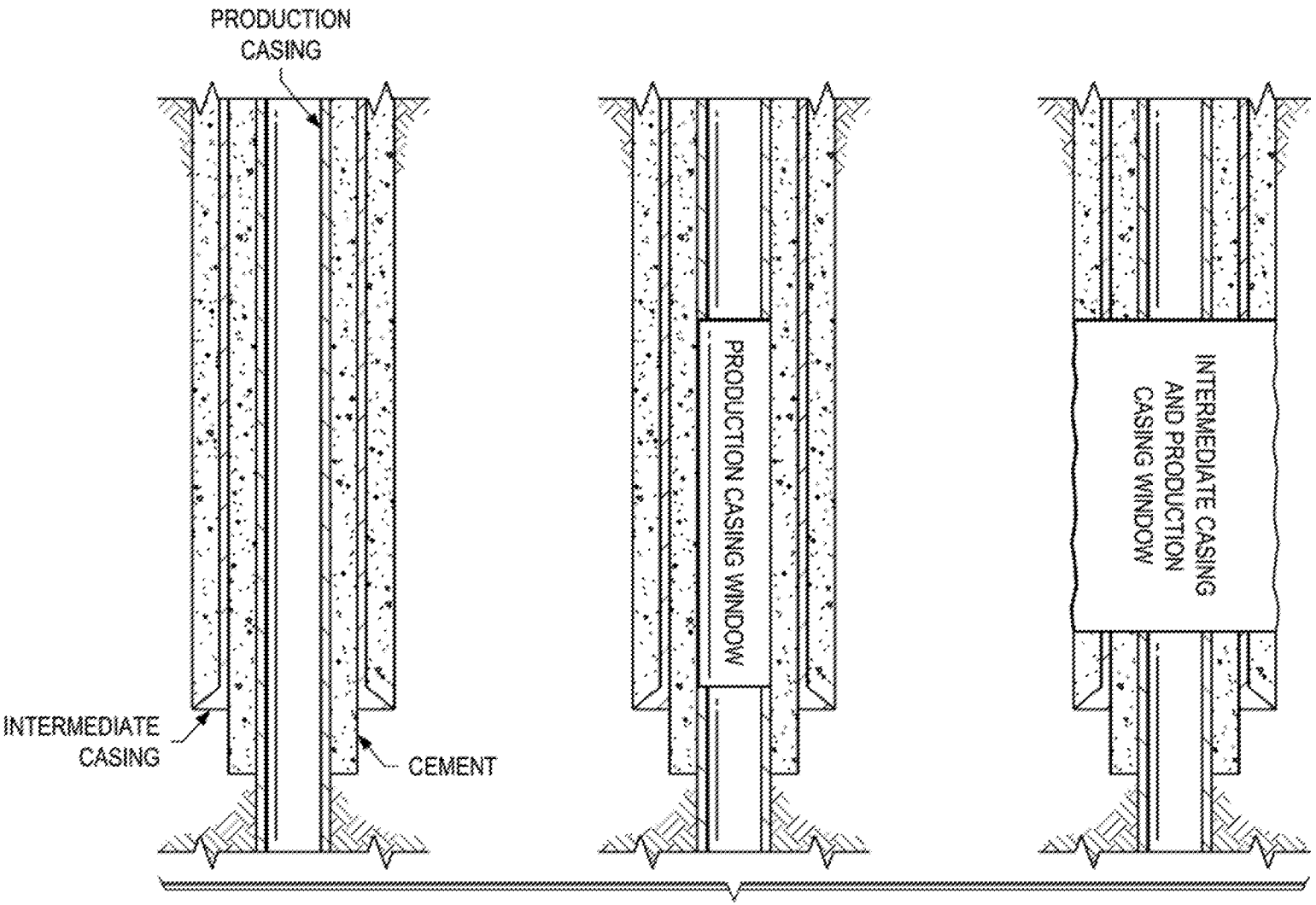
FIG. 3 provides a simple schematic of milled windows. Casing strings of lower completions that are poorly cemented but cemented in a manner that renders them irretrievable (left panel) must be milled. One trip is required to mill the production casing (middle panel) and then separate trips are required for any intermediate casings (right panel) until all annuli and the formation are exposed. The milling debris (swarf) is removed, the hole cleaned, and then cement is run (not shown). The regulations. e.g., in Norway, require 50 meters of casing to be milled, so that 50 m of cement plug can be set, and this generates 1.5 tons of swarf, and an equivalent volume 3 to 5 times greater than the intact joints.
Figure 4C:
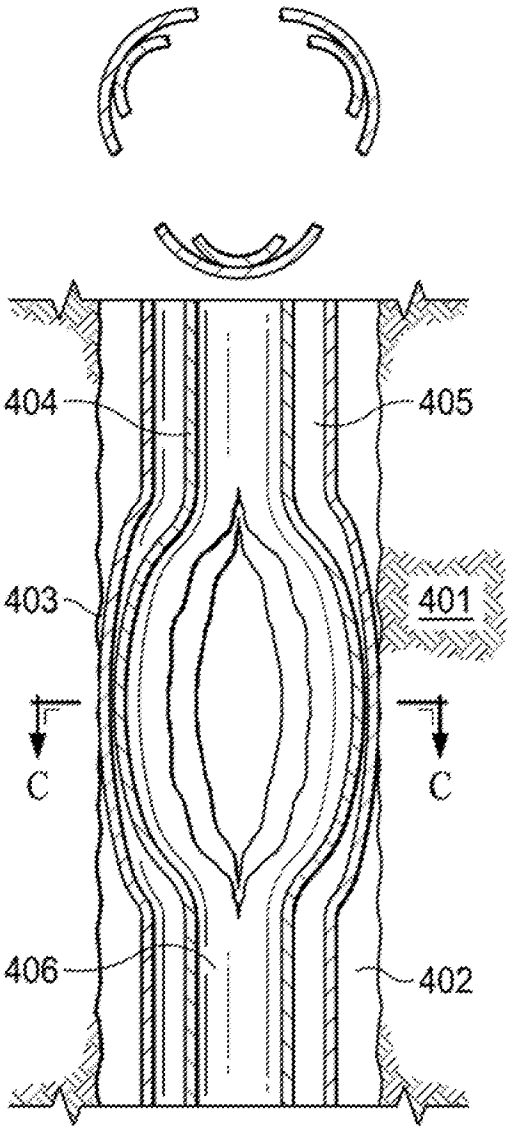
FIG. 4A-J shows one embodiment of the inventive method wherein the tubing and casing are ruptured and expanded using an energetic tool, typically deploying directional charges. This particular figure includes further perforation of the remaining casing before setting the alloy plug, but this step may be optional, if there is suitable access to the annulus outside the exterior casing. Then a resin plug is set, them the cement is set, creating a bi-plug.
Figure 4B:
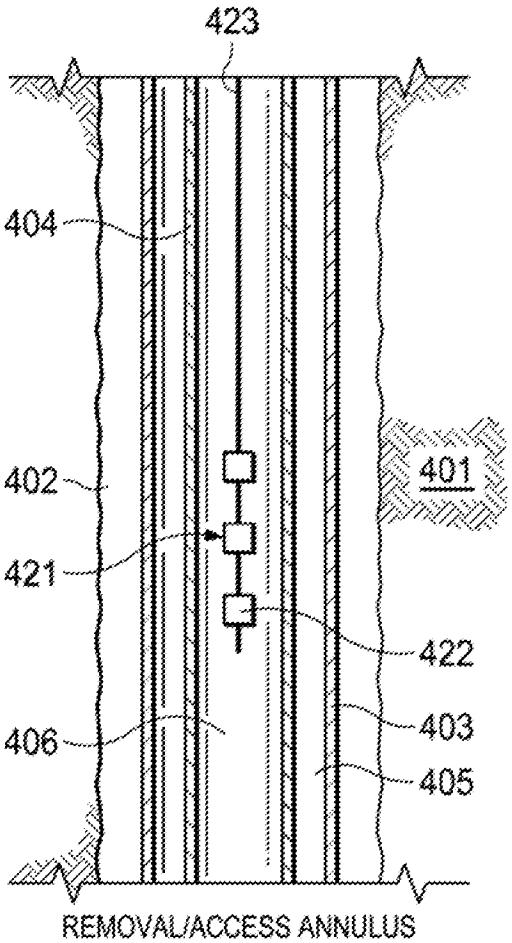
Figure 4A:
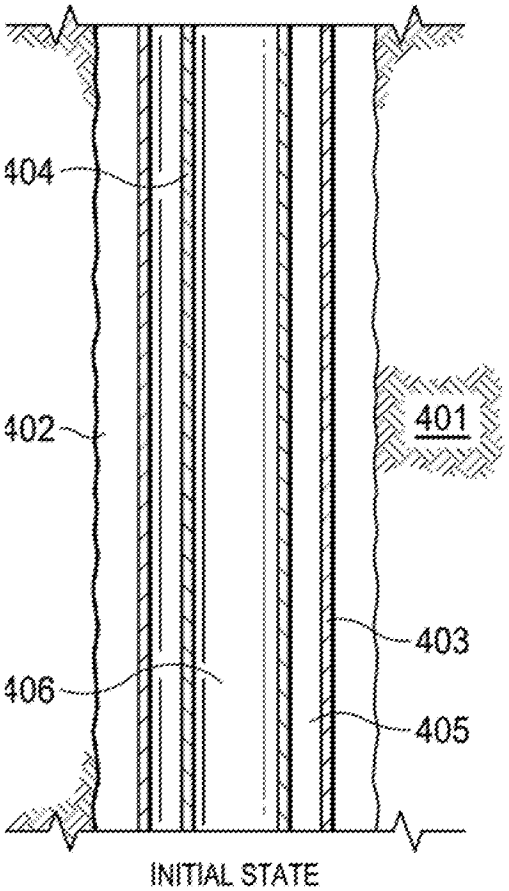
Figure 4F:
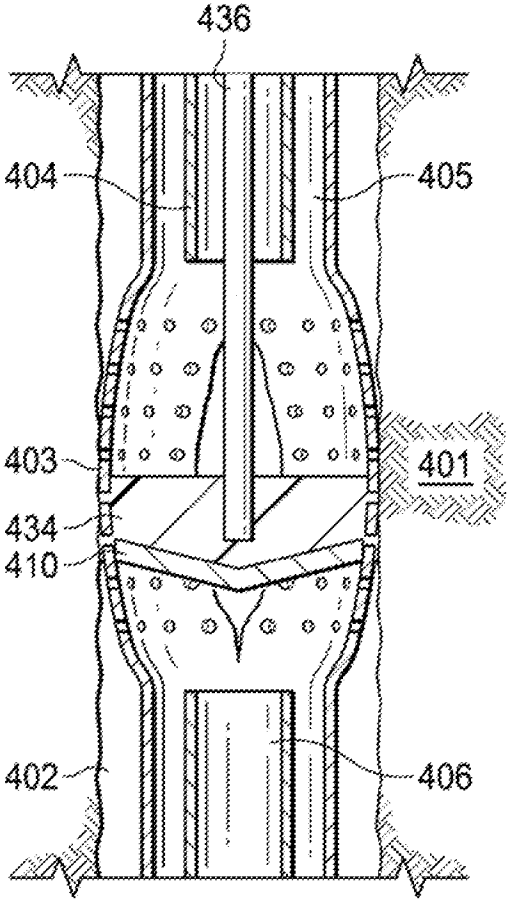

FIG. 4A shows a section of well to be plugged. The reservoir is 401, and there is an annular space 402 between outer casing 403 and reservoir 401. This space 402 either lacks cement or has poor quality cement. Production tubing 404 has an internal space 406 and an annular space 405 between the tubing 404 and casing 403.

A wireline lubricator is placed on top the Christmas tree (not shown). The lubricator contains a tool with an energetic device 421 having charges 422, suspended from the wireline 423, designed to rupture and expand the tubing and casing (FIG. 4B) The device is run to desired depth and ignited. The tubing is thus split into sections and pushed out of the way, as seen in the cross section taken at line C-C in the top panel of FIG. 4C. The casing is also expanded past its yield point, giving access to the annulus surrounding the casing and any defects in the cemented annulus The above energetic tool is only one method of gaining access to the reservoir wall, and other methods that can be used. These other methods include using: i) a milling tool run on wireline or coiled tubing, although this is less preferred as the swarf must be removed; ii) upward milling and allowing swarf to fall downhole, iii) a jetting tool that uses water and abrasives; iv) a plasma melting tool; v) a laser cutter, energetic cutters, propellant cutters, and the like. Note that although milling can be used, it still differs from prior art milling techniques, which mill 50-100 meters of tubing, whereas the method described herein mills only a tenth of that amount (1 foot—5 meters).

The expanded cavity can be washed using a tool (e.g., jet washer) on coil tubing, but this is optional. Access to the annular space between the casing and formation can be assessed, by e.g., camera or sonic log, and if insufficiently ruptured, the casing can also be perforated to give better access to the annulus cavity. A perforated cavity is shown in FIG. 4D, wherein a perforating tool (not shown) has blasted or cut a number of perforations through the casing.

The cavity (before and/or after perforation) can also be mapped using a sonic tool or camera 424 to determine the size of the cavity and access to the reservoir. This and similar verification steps are important when establishing the validity of the method, but may be omitted once sufficient experience has been gained, or the verification and/or washing steps may be performed in different order.

Figure 4E:
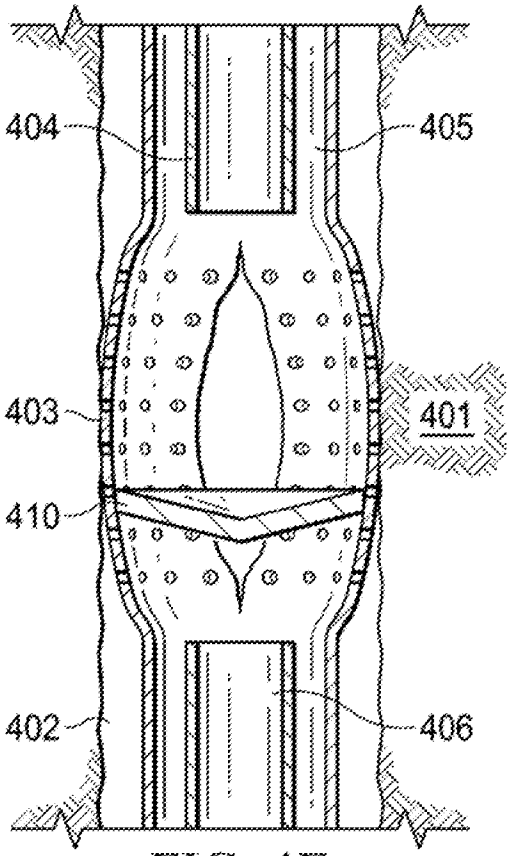
Figure 4D:
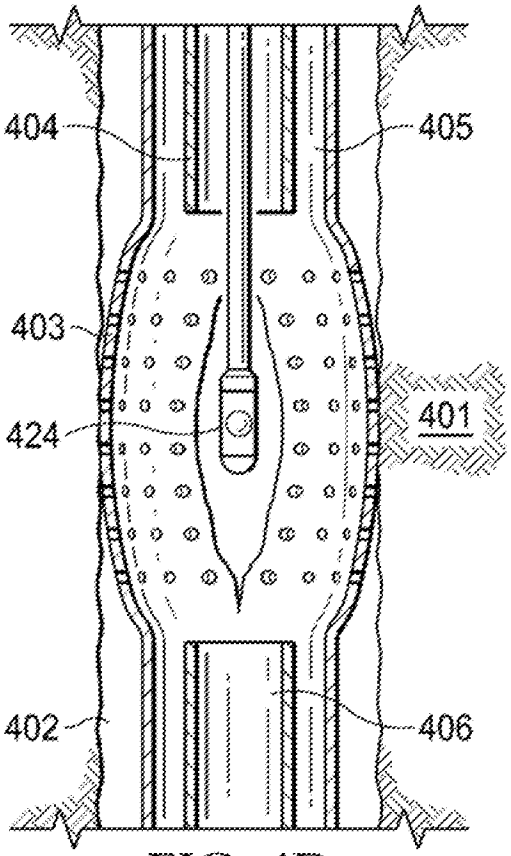

A blocking device 410 can then be run and set in the bottom of the cavity to provide a base or bottom for the abandonment plug 434 (FIG. 4E). This device can be a mechanical device, such as i) an expandable packer; ii) a pedal basket; or, iii) a plug. Alternatively, non-mechanical blocking means, such as a small cement plug, could be set or materials such as sand, heavy mud, Sandaband, could also be placed therein. The blocking device can be set before or after removing the short section of casing/tubing, depending on the type of plug. Another option is to use metal plug formed in place using bismuth alloy. This type of plug will seal the annuli at a short section where casing is milled out or casing expanded/ruptured.

Exemplary devices include the SlikPak™ Plus system, by TAM International, Inc. This is a battery operated, computerized, inflatable, retrievable bridge plug setting system designed to be run on slickline or electric line. Other suitable devices include the ACE Thru Tubing Umbrella Plug, which firmly anchors into place a "metal petal" umbrella that functions as a cement basket to be utilized as a base for subsequent placement (dumping) of bridging material, cement, or resin. Hole Products also offers a complete line of inflatable wireline packers, as does Barracuda Oil Tools. BiSN has Bismuth Alloy plugs that could be used.

The blocking device does not need to be perfect, as resin will fill in any imperfections, solidify, and then prevent further leakage. Further, if the casing is cemented, even with poor quality cement, the rupture and expansion tool will cause the cement behind the rupture zone to crumble and fall downhole, also providing blockage to resin falling downhole. Where an expandable base plug is used and the casing is not cemented, it should be set close to where the expanded tubing meets the wall, to ensure minimal loss of resin downhole. However, this is only one option for setting a blocking device. If desired, the tubing at the bottom of the plug zone can be cut, e.g., with a jet cutter or mill, and the plug set where the tubing is removed, and tubing above the plug ruptured and expanded, etc. There are other ways of setting a reasonably leak-proof base plug that can be used, and the operator can use the most cost effective or convenient method.

Next (FIG. 4F), the cavity is partially filled with a resin that is formulated correctly so as to not mix with reservoir fluids and provide a tight seal, which is placed by running a coil 436 from the surface to the cavity or the top thereof. Then resin 437 is placed in the cavity. If previously mapped, the cavity volume will be known and an appropriate amount of resin can be placed. Levels can also be confirmed by running wireline. The resin in its liquid form would ideally surround the ruptured casing, reaching the rock through the ruptures and/or perforations, and not need a squeeze, but if too thick or viscous for this, a squeeze can be performed. Alternatively, the resin could be placed with a large bailer run on wireline or on tubulars. This resin placement step can be repeated one or more times, depending on the thickness of resin plug desired, and whether there is any leakage of the blocking device.

Figure 4H:
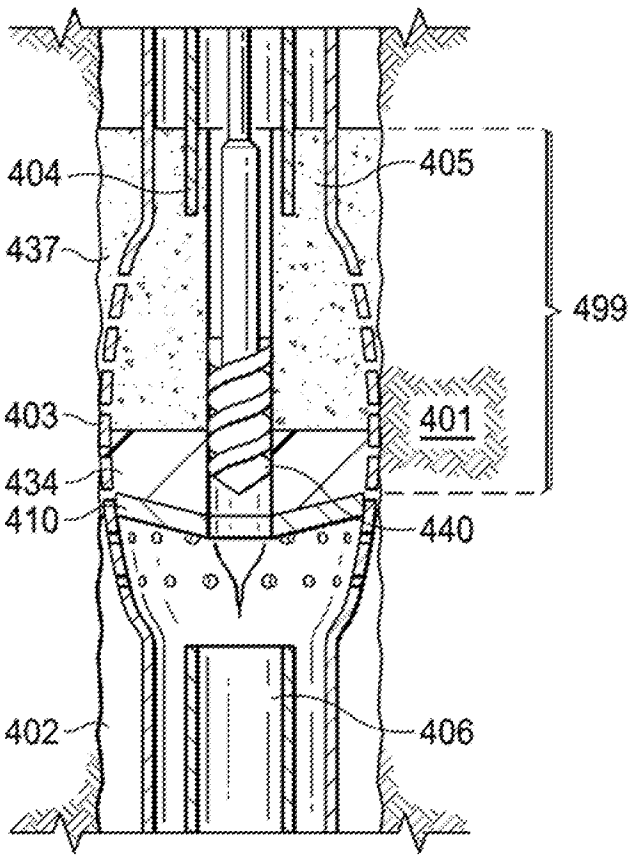
Figure 4G:
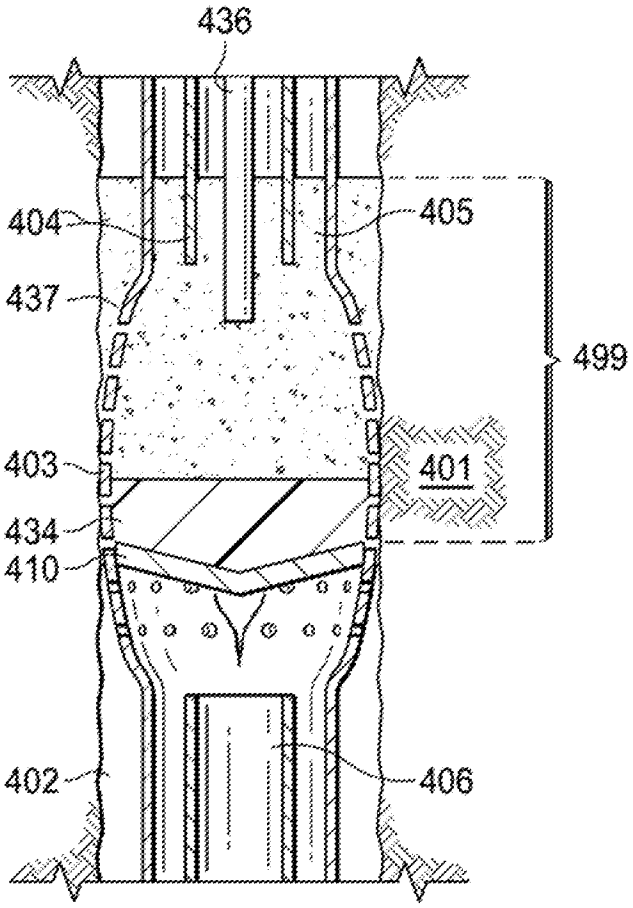

After the resin is cured, the next step is to fill the remaining cavity with cement 437 or to cap the resin plug with cement (FIG. 4G). The cement could be placed by coil tubing and circulated in and possibly squeeze pressure applied if needed. Here we show a portion of the cavity filled with cement as well as some amount of tubing above the cavity. The cement can be placed as balanced plug in the tubing or alternatively the annuli between the tubing and casing can be opened. The cement then can be circulated between the tubing and casing to the desired height. Another option is to place the cement by just pumping cement down the tubing and circulating into the annulus. The method to use depends on the well configuration and if circulating is possible from tubing to the tubing by casing annulus.

If desired or required by regulations, a bore can be made in the plug and a logging tool run to confirm the placement and quality of the bi-plug once fully cured and set. In the future, it may be practical to log the plug without drilling a bore, in which case the bore can be omitted, but current regulations requires the central portion of the bi-plug be drilled out to allow entry of the 360° cement bond tool (FIG. 4H). A drilling tool 440 (e.g., on coiled tubing) drills out the bi-plug 499 to allow logging or other tool 441 on line 442 to log the bi-plug (FIG. 4I) and confirm the quality. The logging tool 441 can measure several different characteristics: i) radioactivity if safe radioactive material is placed in the plug material; ii) bonding to the formation using a sonic or ultrasonic cement bond logging tool; or iii) other types of logging.

Figure 4J:
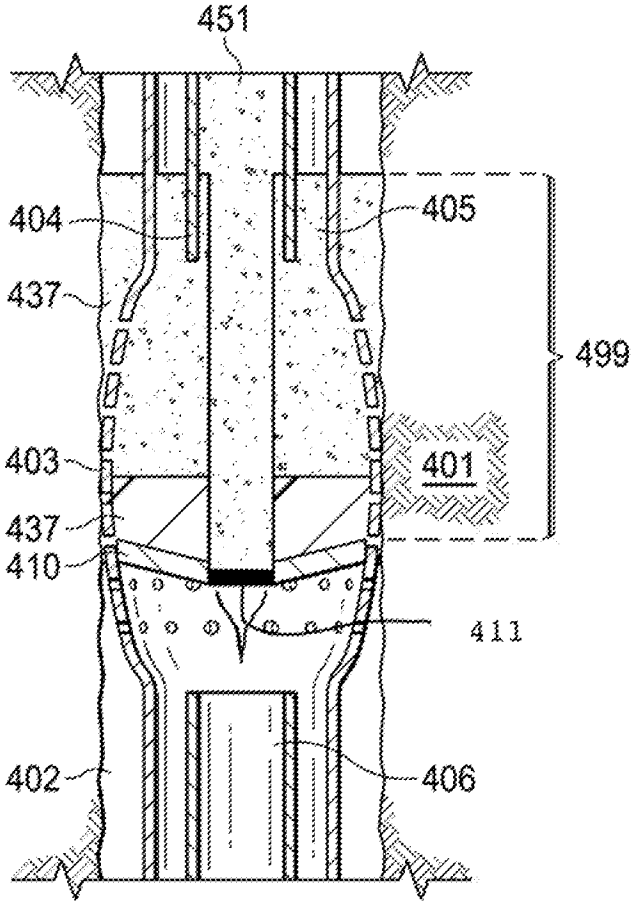
Figure 4I:
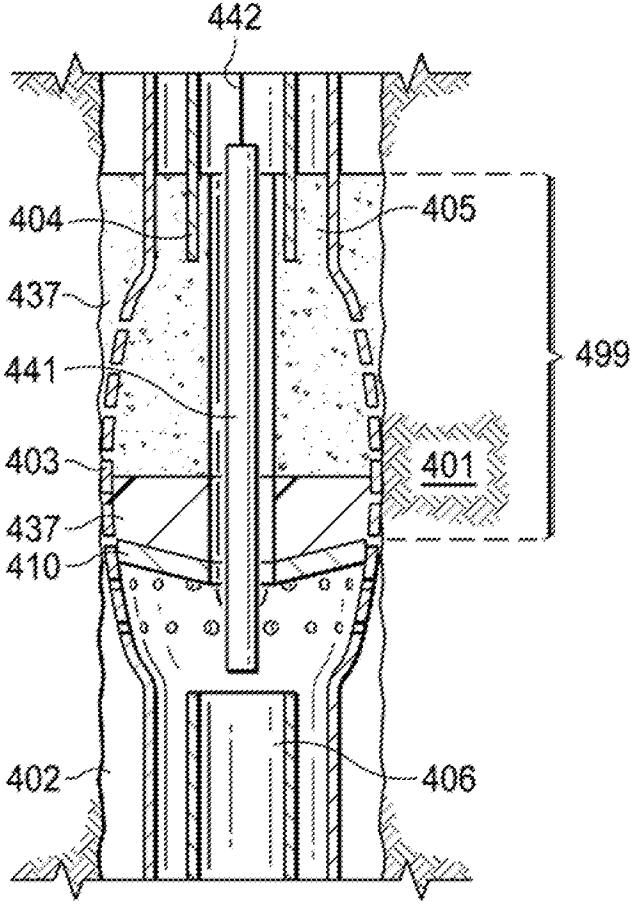

Once a solid connection between the resin/cement and expanded casing and formation is confirmed, another base plug 411 is set and cement 451 or other material refills hole and typically overcaps the two material bi-plug 499 (FIG. 4J). The bore can be filed by deploying a plug or other blocking device, running coil and circulating in cement or other material. Alternative the material could be placed using a dump bailer run on wireline.

Final tests to confirm bi-plug integrity include sonic or ultrasonic logging, positive pressure tests and negative pressure tests, inflow tests, and the like.

To verify the position of a bi-plug, top of cement (TOC) can be tagged. To tag TOC, the work string or toolstring is slowly lowered until a reduction in weight is noticed as the string lands on the cement plug. Plug location and top of cement is then confirmed. To test integrity of a bi-plug, a load test can be performed. A load test is performed by lowering the toolstring onto the TOC, similar to the tagging operation. Then the driller applies weight onto the string and observes the outcome. If the weight on bit (WOB) readings increase as more weight is applied, and the position of the bit is constant, the plug is solid. The tag TOC and load test are often performed at the same time. Pressure tests are also often conducted-both positive and negative pressure tests.

If the annular space outside the exterior casing was adequately cemented, this method could be modified, to mill or cut a small section of tubing and then the two material resin-cement plug used. However, if not cemented, or if the cement bond quality is poor, rupture and expansion or rupture and expansion with optional perforation is preferred.

Rupture and expansion is typically sufficient to crumble any poor cement, which will typically fall further downhole, leaving a clean annular. The crumbled cement will also block the annulus at the bottom of the plugging zone, as the crumble will fill with resin and begin hardening, preventing further leakage.

If there are multiple tubular strings, greater than two, the same process can be done, although expansion and rupture will require greater energy. Two casing strings can also be done this way using the same process.

The following documents are incorporated by reference in their entirety:

US20060144591 Method and apparatus for repair of wells utilizing meltable repair materials and exothermic reactants as heating agents US20100006289 Method and apparatus for sealing abandoned oil and gas wells US20130333890 Methods of removing a wellbore isolation device using a eutectic composition US20130087335, Method and apparatus for use in well abandonment US20150345248, US20150368542, US20160145962, Apparatus for use in well abandonment US20150368542 Heat sources and alloys for us in downhole applications U.S. Pat. No. 6,474,414 Plug for tubulars U.S. Pat. No. 6,664,522 Method and apparatus for sealing multiple casings for oil and gas wells U.S. Pat. No. 6,828,531 Oil and gas well alloy squeezing method and apparatus U.S. Pat. No. 6,923,263 Well sealing method and apparatus U.S. Pat. No. 7,152,657 In-situ casting of well equipment U.S. Pat. No. 7,290,609, Subterranean well secondary plugging tool for repair of a first plug US20150053405 One trip perforating and washing tool for plugging and abandoning wells COP 42399 at U.S. Ser. No. 62/402,796, filed Sep. 30, 2016.

COP 42423, U.S. Ser. No. 62/402,802, filed Sep. 30, 2016.

COP 42425, U.S. Ser. No. 62/62/402,810, filed Sep. 30, 2016.

U.S. Pat. No. 6,679,328—Reverse section milling method and apparatus

WO2014108431 Method for plugging a hydrocarbon well

U.S. Pat. No. 6,478,088 Method for the formation of a ping in a petroleum well

U.S. Pat. No. 6,802,375 Method for plugging a well with resin

The invention claimed is:

1. A through-tube method of plugging a hydrocarbon well, comprising:

a) deploying a tool downhole to remove or to rupture and expand both an inner tubular and an uncemented or poorly cemented exterior casing at a section of a well to be plugged, leaving a remainder of inner tubular in-place;

b) deploying a blocking device downhole if needed to block a bottom of said section either before or after step a;

c) deploying a liquid resin downnhole onto said blocking device to at least partially fill said section;

d) optionally squeezing said liquid resin;

e) allowing said resin to cure and form a first plug of resin;

f) optionally repeating steps c-e;

g) deploying a liquid cement downhole on top of said first plug;

h) optionally squeezing said liquid cement;

i) allowing said liquid cement to cure and form a second plug of concrete;

j) optionally repeating steps g-i; and k) said first plug and said second plug forming a contiguous bi-plug made of two different materials and having more strength than either material used alone.

2. The method of claim 1, wherein an energetic tool is used in step a) to rupture and expand said inner tubular and said exterior casing.

3. The method of claim 2, wherein said ruptured and expanded tubular and exterior casing are further perforated.

4. The method of claim 1, wherein a wireline or coiled tubing deployed milling tool is used in step a) to mill 1 to 5 meters of said inner tubular and said exterior casing.

5. The method of claim 4, wherein said milling tool produces swarf and said swarf is removed by circulation.

6. The method of claim 4, wherein said milling tool uses upward milling and produces swarf that falls downhole.

7. The method of claim 4, wherein a milling tool is used in step a) to mill 1 to 5 meters of said inner tubular and optionally said exterior casing by upward milling and produces swarf that falls downhole.

8. The method of claim 1, wherein a wireline or coiled tubing deployed cutting tool is used in step a) to cut or mill 1 to 5 meters of said inner tubular and said exterior casing.

9. The method of claim 1, wherein said blocking device is a plug, a packer, a basket or melted metal alloy plug using bismuth alloy or other metal.

10. The method of claim 1, wherein said bi-plug is logged to confirm plug quality.

11. The method of claim 1, wherein a bore is drilled through said bi-plug, and said bored bi-plug is logged to confirm plug quality, and then said bore is refilled with cement or resin.

12. A through-tube method of plugging a hydrocarbon well, said method comprising:

a) deploying a tool downhole to remove or to rupture and expand both an inner tubular and an uncemented or poorly cemented exterior casing at a section of a well to be plugged, leaving a remainder of inner tubular in-place;

b) deploying a blocking device downhole if needed to block a bottom of said section either before or after step a;

c) deploying a liquid resin downhole onto said blocking device to at least partially fill said section;

d) optionally squeezing said liquid resin;

e) allowing said resin to cure and form a first plug of resin;

f) optionally repeating steps c-e;

g) deploying a liquid cement downhole on top of said first plug;

h) optionally squeezing said liquid cement;

i) allowing said liquid cement to cure and form a second plug of concrete;

j) optionally repeating steps g-i;

k) said first plug and said second plug forming a contiguous bi-plug made of two different materials and having more strength than either material used alone; and l) wherein said milling tool produces swarf and said swarf is removed by chemical dissolution of said swarf.

13. The method of claim 12, wherein a bore is drilled through said bi-plug, and said bored bi-plug is logged to confirm plug quality, and then said bore is refilled.

14. A through-tube method of plugging a hydrocarbon well, comprising:

a) removing an inner tubular, but not a cemented exterior casing, at a 1-5 meter section of well to be plugged, leaving a remainder of inner tubular in-place;

b) deploying a blocking device downhole to block a bottom of said section;

c) deploying a liquid resin downhole onto said blocking device to partially fill said section and allow said resin to cure and form a first plug;

d) deploying cement downhole on top of said first plug;

e) optionally squeezing said cement; and f) allowing said cement to solidify and form a second plug adjacent to and touching said first plug, said first plug and said second plug making a bi-plug.

15. The method of claim 14, wherein a wireline or coiled tubing deployed milling tool is used in removing step a) to mill <2 meter of said inner tubular and said exterior casing.

16. The method of claim 15, wherein said milling tool produced swarf and said swarf is removed by circulation.

17. The method of claim 14, wherein a wireline or coiled tubing deployed cutting tool is used in removing step a) to cut or mill 1 to 5 meters of said inner tubular and said exterior casing.

18. A through-tube method of plugging a hydrocarbon well, comprising:

a) deploying a tool downhole to remove or to rupture and expand an inner tubular and optionally an exterior casing at a section of a well to be plugged, leaving a remainder of inner tubular in-place;

b) deploying a blocking device downhole if needed to block a bottom of said section either before or after step a;

c) deploying a liquid resin downhole onto said blocking device to at least partially fill said section;

d) optionally squeezing said liquid resin;

e) allowing said resin to cure and form a first plug of resin;

f) optionally repeating steps c-e;

g) deploying a liquid cement downhole on top of said first plug;

h) optionally squeezing said liquid cement;

i) allowing said liquid cement to cure and form a second plug of concrete;

j) optionally repeating steps g-i;

k) said first plug and said second plug forming a contiguous bi-plug made of two different materials and having more strength than either material used alone;

l) drilling a bore through said bi-plug;

m) logging said bored bi-plug to confirm plug quality; and n) refilling said bore with resin or cement.

19. The method of claim 18, wherein an energetic tool is used in step a) to rupture and expand said inner tubular and optionally said exterior casing.

20. The method of claim 18, wherein a milling tool is used in step a) to mill 1 to 5 meters of said inner tubular and optionally said exterior casing, wherein said milling tool produces swarf and said swarf is removed by circulation.

* * * * *